US006041470A

United States Patent [19]

Branham et al.

[11] Patent Number: 6,041,470

[45] Date of Patent: Mar. 28, 2000

[54] CARPET BRUSH CLEANING DEVICE

[76] Inventors: James C. Branham, 4824 Kester Mill Ct., Winston-Salem, N.C. 27103; Vincent P. Barry, 224 Bradford Lake Ct., Lewisville, N.C. 27023; Dale E. Hogue, 1581 Thomas Rd., Hubbard, Ohio 44425

[21] Appl. No.: 09/182,597

[22] Filed: Oct. 30, 1998

[51] Int. Cl.[7] ..... A47L 5/38

[52] U.S. Cl. ..... 15/310; 15/142; 15/311

[58] Field of Search ..... 15/310, 311, 142, 15/257.01, 257.1

[56] References Cited

U.S. PATENT DOCUMENTS

| | | | |
|---|---|---|---|
| 1,898,887 | 2/1933 | Naul | 15/142 |
| 2,197,869 | 4/1940 | Kramer | 15/142 X |
| 2,724,856 | 11/1955 | Conkey | 15/310 |
| 2,764,776 | 10/1956 | Peguero | 15/310 |
| 2,933,752 | 4/1960 | McLennon | 15/311 |
| 2,977,620 | 4/1961 | Nilsson . | |
| 3,056,993 | 10/1962 | Lewis | 15/310 |
| 3,411,174 | 11/1968 | Jordan | 15/310 |
| 4,037,287 | 7/1977 | Whittaker . | |
| 4,099,286 | 7/1978 | Ishikawa | 15/142 |
| 4,386,444 | 6/1983 | Whittaker . | |

*Primary Examiner*—Chris K. Moore
*Attorney, Agent, or Firm*—Harpman & Harpman

[57] ABSTRACT

A commercial carpet brush cleaning device that removes built-up accumulations of carpet fibers and associated cleaning compound residue and dirt from a carpet cleaning brush. An elevated machine receiving area is defined having a plurality of arcuately spaced elongated openings therein and corresponding upstanding elongated cleaning tines assemblies are positioned in spaced inter-related relations to the openings. A collection and evacuation chamber below the openings removes the brush waste as it is cleaned by the rotation of the brush on the cleaning tines assembly within the device.

8 Claims, 4 Drawing Sheets

CARPET BRUSH CLEANING DEVICE

BACKGROUND OF THE INVENTION

1. Technical Field

This device relates to commercial carpet cleaning machines that have large bristle type circular brushes that are used to scrub carpets with cleaning compound to loosen and remove dirt therefrom. Specifically, to cleaning devices for carpet brushes that remove accumulated carpet fibers and cleaning residue from the brushes after use.

2. Description of Prior Art

Prior art devices of this type use brush and pad engagement elements to dislodge and direct built-up residue by the rotation of the brush or buffing pad on the cleaning engagement elements as shown in U.S. Pat. Nos. 4,386,444, and 4,037,287.

In U.S. Pat. No. 4,037,287, a buffing machine pad cleaning device is disclosed having a plurality of curved cleaning bars arranged in radial pattern over a large number of apertures in a pad supporting surface. The cleaning bars define a horizontally irregular cleaning surface thereabout on which the buffing machine is positioned and associated pad rotated. A collection access door is used to remove dislodged debris after cleaning.

U.S. Pat. No. 4,386,444 is a similar buffing pad cleaning device wherein a plurality of straight radially positioned bars actually define an annular support surface on which the buffing machine and associated pad is positioned and run.

A device for cleaning multiple rotatable brushes in a floor polishing machine is illustrated in U.S. Pat. No. 2,977,620. A machine enclosure is illustrated having multiple sets of upstanding tabs formed from a platform by punching out same. Each of the upstanding tabs is notched along its upper edge surface so as to define notched elements abutting the elongated opening from which the tab is formed.

Applicant's invention provides an improved carpet cleaning brush device having multiple bands of multiple upstanding aligned cleaning elements in spaced relation to inner disposed evacuation openings in a vacuum chamber. This allows for the cleaning and removal of accumulated fibers and cleaning material residue from within the brush as it is rotated by the machine over the cleaning tines.

SUMMARY OF THE INVENTION

A carpet cleaning brush device that supports and holds a carpet cleaning machine with attached carpet cleaning brushes on an elevated cleaning engagement surface. A plurality of strategically placed brush engagement elements remove impacted carpet fibers and associated carpet debris and evacuate them through vacuum portals. The brush engagement area is enclosed by a perimeter upstanding wall to channel removed materials into the inner space removal portals which are in communication with a source of vacuum.

DESCRIPTION OF THE PREFERRED EMBODIMENT

Figure 1:
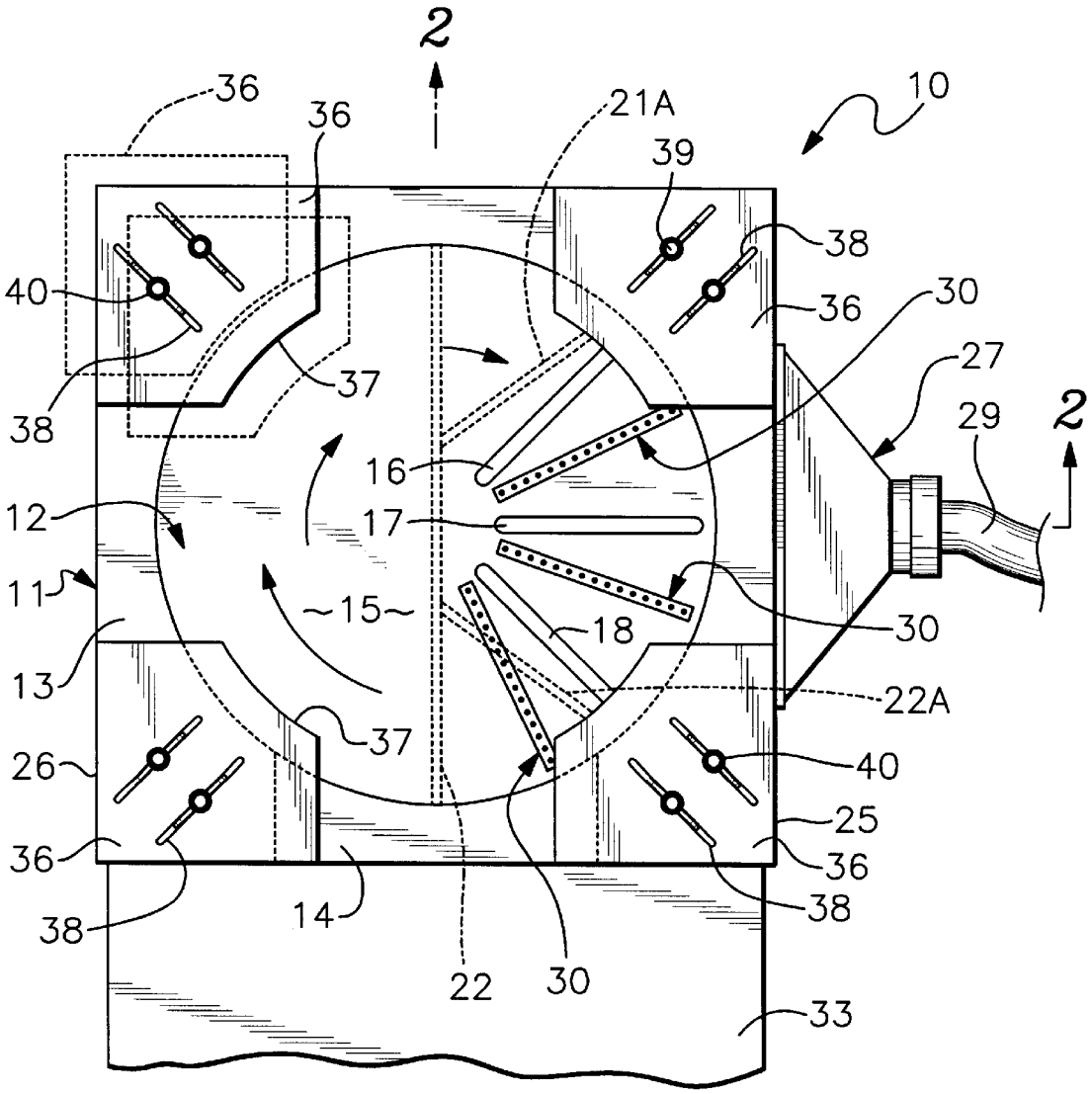
FIG. 1 is a top plan view of the carpet brush cleaning device of the invention.
Figure 2:
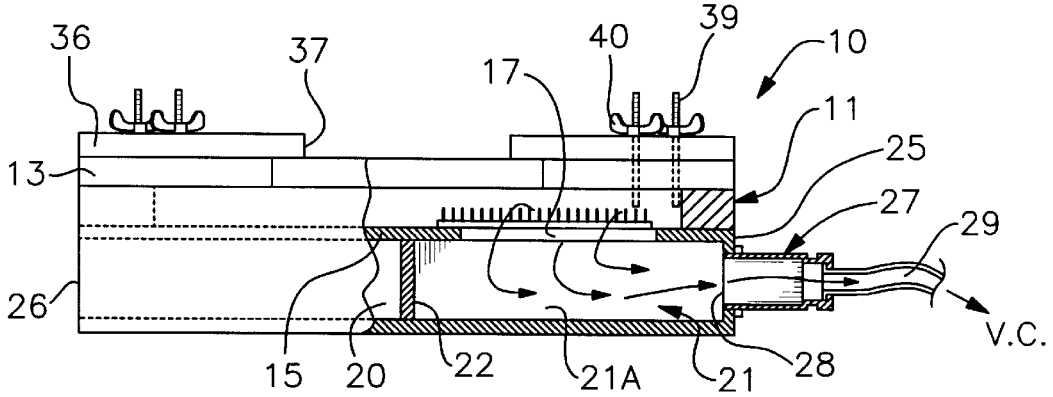
FIG. 2 is a partial section on lines 2—2 of FIG. 1 and side elevation.
Figure 4:
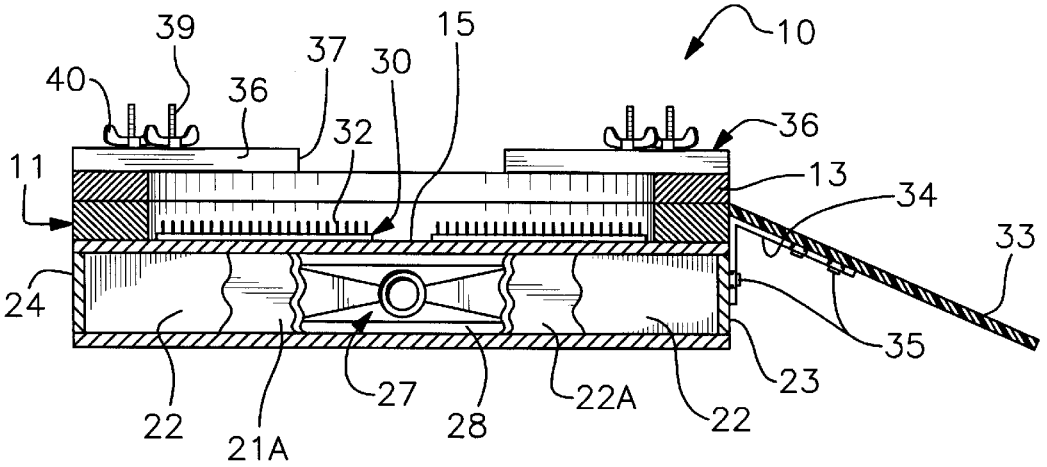
FIG. 4 is a sectional view on lines 4—4 of FIG. 3.
Figure 3:
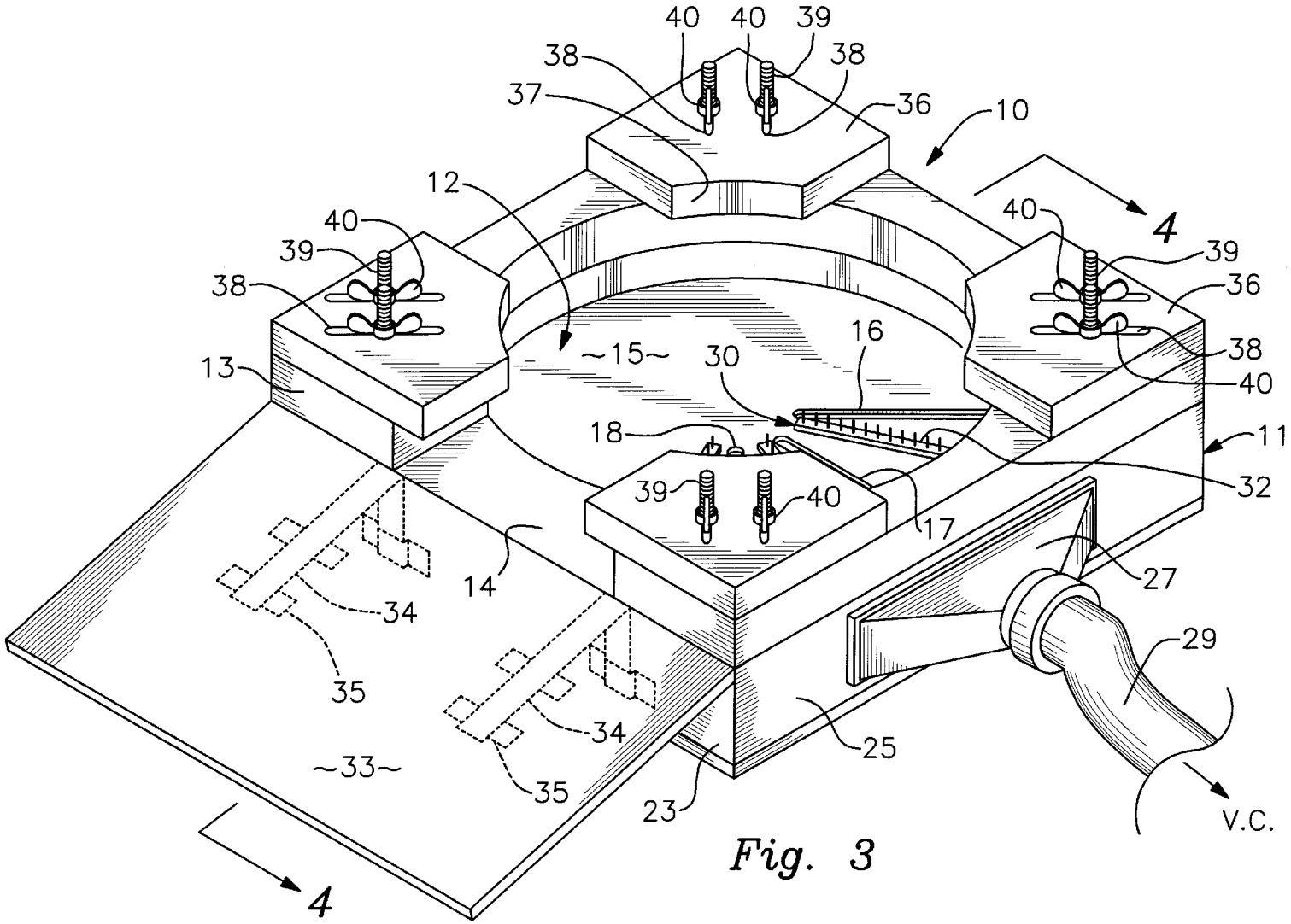
FIG. 3 is a top, front and side perspective view of the carpet cleaning brush device of the invention.

Referring to FIGS. 1, 2 and 3 of the drawings, a carpet brush cleaning device 10 can be seen having a main enclosure 11 defining a generally square configuration with a large circular recessed area 12 within. A corresponding spacer ring 13 extends from the enclosure 11 about the recessed area 12 with an access opening at 14 therein. The main enclosure 11 has a flat bottom receptacle area 15 within the recessed area 12. A plurality of elongated evacuation apertures at 16, 17, and 18 respectively are formed within the receptacle area 15 extending radially outwardly from a central portion as best seen in FIGS. 1, and 3 of the drawings. Support and vacuum chambers 20 and 21 respectively extend below the receptacle area 15 with the evacuation openings 16–18 in communication with the vacuum chamber 21. The support chamber 20 is defined by a bearing wall 22 extending transversely within the enclosure 11. The vacuum chamber 21 is defined by a pair of angularly spaced bulk heads 21A and 21B that extend from the bearing wall 22 to respective front and back walls 23 and 24 of the enclosure 11. It will be evident that the bearing wall 22 divides the enclosure 11 midway between the sidewalls 25 and 26 as hereinbefore described.

A vacuum fitting 27 is secured over an opening 28 in the sidewall 25 within the vacuum chamber 21 as best seen in FIG. 2 of the drawings. A flexible vacuum hose 29 extends from the vacuum fitting 27 to a source of vacuum generally indicated by a directional arrow VC. A plurality of brush engagement assemblies 30 are positioned on the receptacle area 15 in spaced radial relation between the respective evacuation openings 16–18 as hereinbefore described.

Figure 6:
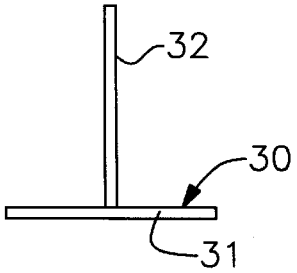
FIG. 6 is an enlarged end elevational view of a cleaning element assembly.
Figure 7:
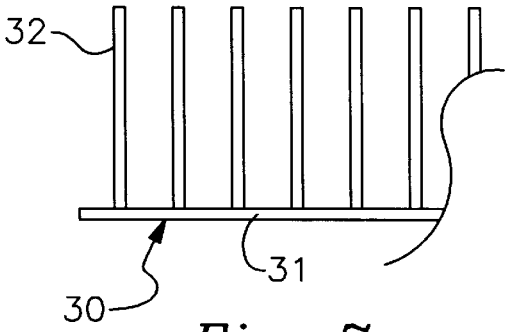
FIG. 7 is an enlarged partial side elevational view of the cleaning element assembly.

Each of the brush engagement assemblies 30 have a rectangular mounting flat base plate 31 with a plurality of longitudinally spaced aligned upstanding tines 32 extending therefrom as best seen in FIGS. 3, 6 and 7 of the drawings.

The brush engagement assemblies 30 are preferably made of metal and are affixed to the receptacle area 15. It is important to note that the brush engagement assemblies 30 and interdisposed evacuation openings 16–18 overlie only the vacuum chamber area 21 and thus cover only a portion of the circular receptacle area 15 as best seen in FIG. 1 of the drawings. This positioning is important to the overall efficiency of the carpet brush cleaning device 10 of the invention in that as a carpet brush machine (not shown), well known within the art, rotates the carpet brush within the recessed area 12 on the receptacle area 15 only a portion of the carpet brush is engaged by the cleaning assemblies at a time. Thus the rotation action within the confined recess portion 12 against the brush engagement assemblies 30 will exfoliate entrained carpet fibers and debris (CBFD) so as to be expelled by the repeated sequential engagement of the individual tines 32 of the brush cleaning assemblies 30.

An access ramp 33 is removably secured to the front wall 23 of the enclosure 11 by engagement brackets 34 secured to the ramp and registerable in two respective bracket fittings 35 on the wall 23 as best seen in FIGS. 1, 3, 4 and 5 of the drawings.

Figure 5:
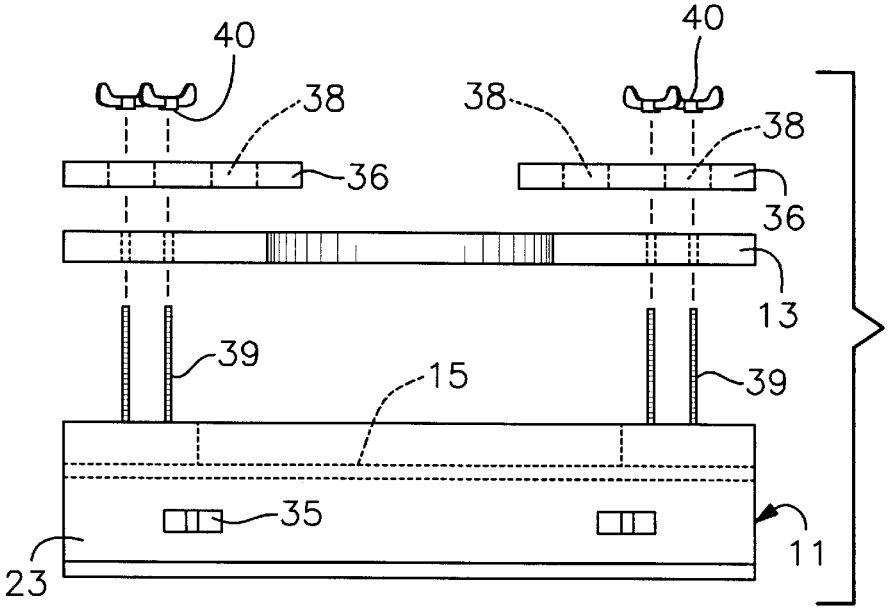
FIG. 5 is an exploded view of the carpet brush cleaning device illustrating the main cleaning structure and spacing rings associated therewith.

In order for the carpet brush cleaning device 10 of the invention to be adaptable to variance in carpet cleaning machines (not shown) sizes, multiple adjustable machine engagement brackets 36 are provided and that are removably positioned on the enclosure 11 either on the spacer ring 13 as shown in solid lines in FIGS. 1–4 or alternately to the top of the enclosure 11 as generally seen in broken lines in FIG. 5 of the drawings. Each of the machine engagement brackets 36 has a generally flat rectangular configuration with an arcuate corner 37 that conforms to the circular recessed area 12. A pair of spaced parallel adjustment and mounting slots at 38 are registerable on pairs of upstanding threaded fasteners 39 that extend from the enclosure 11 and through the spacer ring 13 as best seen in FIG. 5 of the drawings. Fixation nut fittings 40 are threadably engaged on the threaded fasteners 39 allowing for horizontal angular adjustment in two directions as illustrated by the broken lines and directional arrow in FIG. 1 of the drawings.

It will be evident from the above description that by adjusting the machine engagement brackets 36 towards and away from the enclosure area 12 that a variety of different size machines can be accommodated within the given parameters of the enclosure 11 while always accommodating and centrally position such machines and associated brushes within the recess 12 for proper engagement by the cleaning assemblies as hereinbefore described.

It will therefore be evident that by use of the brush cleaning device 10 of the invention, carpet brushes can be easily and efficiently cleaned by their sequential engagement over the carpet cleaning tines and the carpet fiber and debris CBFD can be easily removed from the recessed area 12 by the source of vacuum VC and its vacuum chamber 21 which is in communication with the evacuation slots 16–18.

By use of the carpet brush cleaning device of the invention, the carpet brushes can be reused rather than discarded and the use of new carpet scrubbing brushes required as hereinbefore was the case.

It will be evident to those skilled in the art that various changes and modification may be made therein without departing from the spirit of the invention.

Therefore I claim:

1. A carpet brush cleaning device comprising; a main enclosure, having a large circular recessed area within, said recessed area having a flat receptacle surface and an upstanding annular wall formed thereabout, a plurality of radially spaced raised brush engagement assemblies on a portion of said receptacle surface, a plurality of elongated openings in said receptacle surface interdisposed between and in parallel spaced relation to said brush engagement assemblies, a vacuum chamber in communication with said elongated openings in said receptacle surface, a source of vacuum connected to said vacuum chamber, means for adjusting the effective annular dimension of the recessed area, means for adjusting the overall height of said enclosure and depth of said recessed area therein and access means on said enclosure.

2. The carpet brush cleaning device set forth in claim 1 wherein said brush engagement assembly comprises: an elongated mounting base, and a plurality of longitudinally spaced and aligned upstanding tines extending from said mounting base.

3. The carpet brush cleaning device set forth in claim 1 wherein said vacuum chamber in communication with said elongated openings in said recessed area comprises; a bearing wall within said enclosure, a pair of oppositely disposed bulk heads extending from said bearing wall to front and back walls of said enclosure.

4. The carpet brush cleaning device set forth in claim 1 wherein said means for adjusting the effective annular dimension of said recessed area comprises; a multiplicity of machine engaging brackets, said engagement brackets registerably positioned on said enclosure in spaced relation to said recessed area.

5. The carpet brush cleaning device set forth in claim 4 wherein said machine engaging brackets are movable on said enclosure towards and away from said recessed area.

6. The carpet brush cleaning device set forth in claim 1 wherein said means for adjusting the overall height of said enclosure and depth of said recessed area comprises; a spacer ring removably positioned on said enclosure about said recessed area.

7. The carpet brush cleaning device set forth in claim 6 wherein said spacer ring has an access opening within.

8. The carpet brush cleaning device set forth in claim 1 wherein said access means on said enclosure comprises; an inclined ramp removably secured to said enclosure.

* * * * *